US006015100A

United States Patent [19]

Restive

[11] Patent Number: 6,015,100

[45] Date of Patent: Jan. 18, 2000

[54] FOAM GENERATING NOZZLE ASSEMBLY WITH INTERCHANGEABLE NOZZLE TIP

[75] Inventor: Mario J. Restive, Frankfort, N.Y.

[73] Assignee: The Fountainhead Group, Inc., New York Mills, N.Y.

[21] Appl. No.: 09/114,766

[22] Filed: Jul. 14, 1998

Related U.S. Application Data

[60] Provisional application No. 60/052,585, Jul. 15, 1997.

[51] Int. Cl.[7] ..... B05B 7/30

[52] U.S. Cl. ..... 239/428.5

[58] Field of Search ..... 239/428.5, 311, 239/600

[56] References Cited

U.S. PATENT DOCUMENTS 3,764,069 10/1973 Runstadler, Jr. et al. .
3,918,647 11/1975 Lamz et al. .
4,103,827 8/1978 Kumazawa .
4,219,159 8/1980 Wesner .
4,330,086 5/1982 Nysted .
4,588,131 5/1986 Yamamoto et al. .
4,619,402 10/1986 Yamamoto .
4,742,642 5/1988 Yamamoto .
5,054,688 10/1991 Grindley .
5,085,371 2/1992 Paige .

*Primary Examiner*—Andres Kashnikow
*Assistant Examiner*—Davis Hwu
*Attorney, Agent, or Firm*—Harter, Secrest & Emery LLP; Brian B. Shaw

[57] ABSTRACT

A low pressure foaming nozzle assembly having a modular construction for permitting the ready interchange of nozzle tips. An elongate housing slideably receives a nozzle tip, a throat and a venturi deflector/nozzle to employ the venturi effect and draw air through radial ports into the housing. The housing cooperatively engages a foaming liquid source such as a wand, and upon pressure on the foaming liquid source, a foam is generated.

14 Claims, 4 Drawing Sheets

FOAM GENERATING NOZZLE ASSEMBLY WITH INTERCHANGEABLE NOZZLE TIP

This Appln claims the benefit of U.S. Provisional Appln No. 60/052,585 filed Jul. 15, 1997.

FIELD OF THE INVENTION

The present invention relates to nozzles for aerating a relatively low pressure liquid stream to produce a sprayable foam, and more particularly, to a nozzle assembly which permits ready interchangeability of a nozzle tip for creating different foam spray application patterns.

BACKGROUND OF THE INVENTION

Foams are typically produced by the mixing of a chemical, water and a gas under certain conditions. The particular chemicals employed depends upon the desired use of the foam. For example, in the agricultural arena foams are often used to apply pesticides and are often preferable to liquid application.

The application of chemicals in a foamed condition offers a number of benefits. The foam application permits the chemicals to be used with lower supply rates and active chemical content, thereby reducing costs. Further, the use of a foam composition reduces health and safety hazards caused by the splashing or drift of tiny droplets or a fine mist. Because a foam is readily visible it also provides a convenient way for visually determining coverage.

Generally, two basic methods have been utilized to generate foams. One method is the use of a chemical foaming agent which is added to the solution, and the solution is then foamed. The other method is the introduction of gas such as air into the liquid to form minute bubbles, thereby collectively forming the foam. The application of agricultural chemicals by foam generating equipment traditionally includes a nozzle unit which mixes air with liquid chemicals.

The type and consistency of foam created by particular foam generating nozzles is a function of a number of factors, including the chemicals to be applied, the pressure of the material when applied to the nozzle unit and the design of the nozzle unit. A resulting consistency of the foam is often dictated by the anticipated application. That is, for applications requiring prolonged retention on a vertical or downward facing surface, it is usually desirable to apply the material as a thick foam. Such foams often follow a 1:10 ratio, that is for each unit volume of liquid, 10 unit volumes of foam are produced. Alternatively, if penetration of a porous surface is desired, the foam is preferably formed with a minimally sized bubbles in a ratio of approximately 1:2.

It has been found that at the relatively low operating pressures, it is difficult to obtain sufficiently small particle size and hence sprayable foam generation. Therefore, prior systems have relied upon relatively high fluid pressures for foam generation. The prior foam generating devices are relatively high pressure units requiring 40 psi or more. The mechanisms required to generate these relatively high pressures and the inability of the foaming nozzles to efficiently use the available energy at low pressures have prevented relatively low pressure foaming technology in a truly portable, human transportable foaming apparatus.

Further, in view of the relatively complicated structure required for the passage of a liquid, introduction of air, generation of foam and application of the foam, a given foaming nozzle unit traditionally creates only a single type foam. That is, if alternative chemical compositions, or application patterns are desired, the nozzle unit must be completely removed and an entirely new nozzle unit applied. This increases the cost of the foam applicators.

Therefore, a need exists for a foaming nozzle assembly which is easily reconfigured to create a variety of foams. Further, the need exists for a foam generating nozzle which may be readily disassembled, cleaned and reassembled. The need also exists for such a nozzle assembly which may be reconfigured with interchangeable components. A further need exists for a foam generating nozzle that can be used in relatively low pressure applications, such as less than approximately 35 psi and still generate sufficient quantities of foam.

SUMMARY OF THE INVENTION

The present invention provides a foaming nozzle assembly for generating a sprayable foam at relatively low fluid pressures, below approximately 35 psi. Preferably, the foaming nozzle produces foam at pressures as low as 25 psi. The present foaming nozzle assembly may be readily attached to a wand. The foaming nozzle may also be disconnected from the wand and disassembled to allow for the ready interchangeability of the components, including a nozzle tip. Thus, the present invention allows a modification of the foam characteristics and application pattern without requiring the use of an entirely new assembly. The sprayable foam formed by the present foaming nozzle assembly reduces wind drift, lowers the required chemical concentration and allows for visual confirmation of both the spray path and the treated areas.

Generally, the present foaming nozzle assembly includes an elongate housing with a first end configured to releasably engage a conduit or wand, and a second end defining an outlet aperture. The housing further includes a stop and a radially directed air inlet port. The foaming nozzle assembly further includes a nozzle tip having a shoulder for cooperatively engaging the stop. The nozzle tip is constructed to be slidably disposed within the housing from the first end so as to seat against the stop and substantially occlude the outlet aperture. The foaming nozzle assembly further includes a throat having a divergent end and a convergent end, the throat being sized to be slidably disposed within the housing and contact the divergent end with the nozzle tip. Finally, the foaming nozzle assembly includes a venturi nozzle/deflector sized to be disposed within the housing such that the deflector portion operably aligns with the air inlet port in the housing and the venturi nozzle/deflector contacts the convergent end of the throat.

The present invention also contemplates a method of assembling a foaming nozzle assembly including slidably disposing a nozzle tip within an elongate housing, such that motion of the nozzle tip through the housing is limited by contact between the nozzle tip and the housing; disposing a diverging throat within the housing to be operably disposed with respect to the nozzle tip; disposing a venturi nozzle/deflector within the housing to operably align with the throat, thereby providing fluid communication through the venturi nozzle/deflector, the throat and the nozzle tip, and providing fluid access from a radial port in the housing to a convergent end of the throat.

DETAILED DESCRIPTION OF THE PREFERRED EMBODIMENTS

Figure 1:
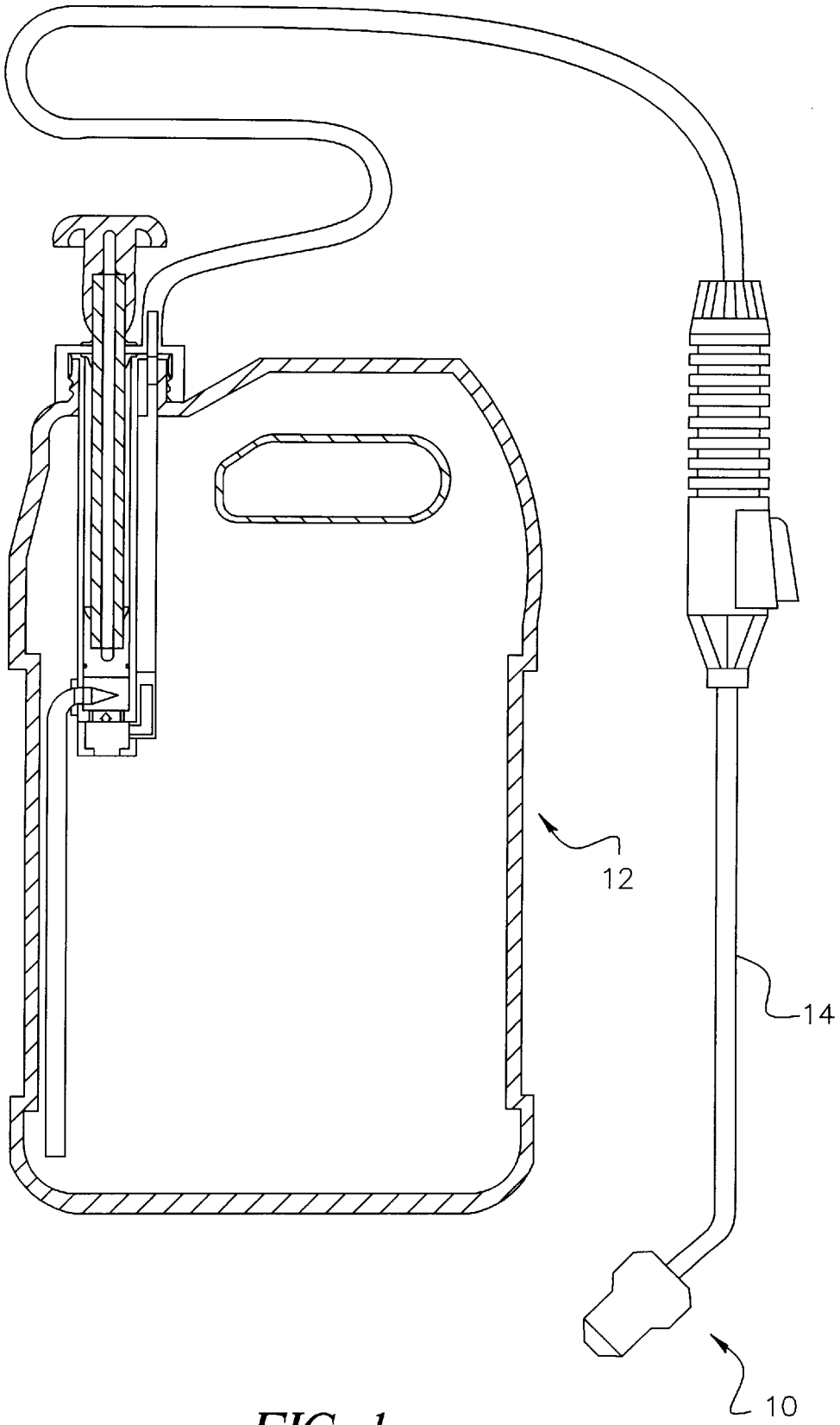
FIG. 1 is a side elevational partial cross sectional view of a foaming nozzle assembly operably connected to a liquid source.
Figure 2:
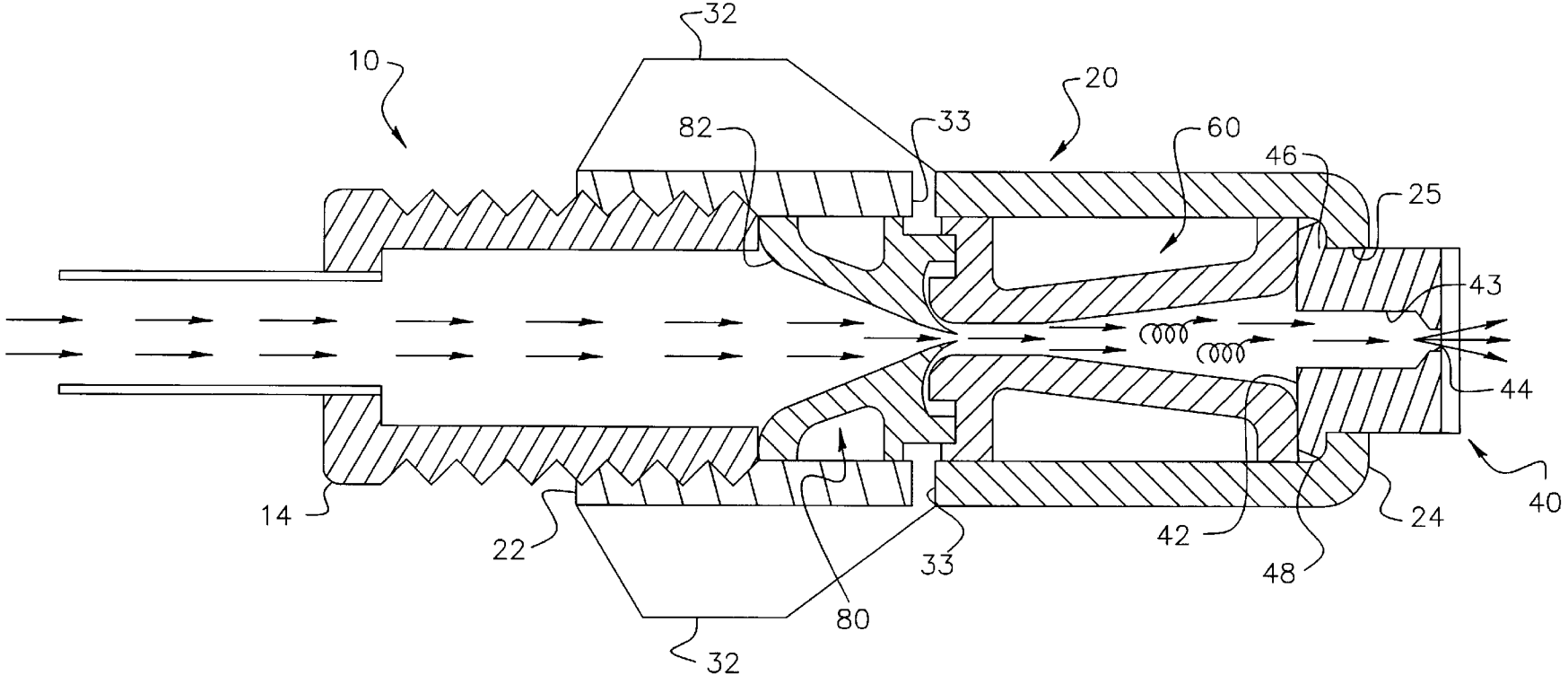
FIG. 2 is a cross sectional view of the foaming nozzle assembly.
Figure 3:
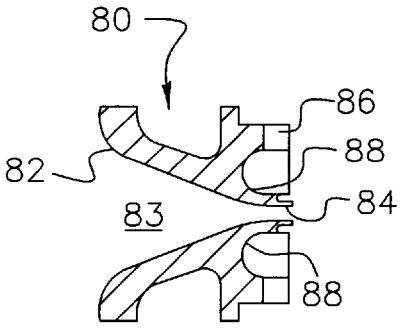
FIG. 3 is a cross sectional view of a venturi nozzle/deflector for the foaming nozzle assembly.
Figure 4:
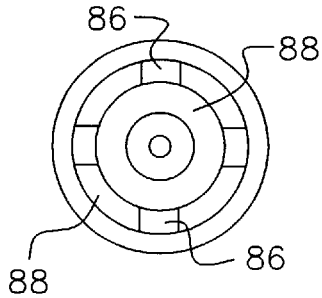
FIG. 4 is an end view from downstream of the venturi nozzle/deflector of FIG. 3.
Figure 5:
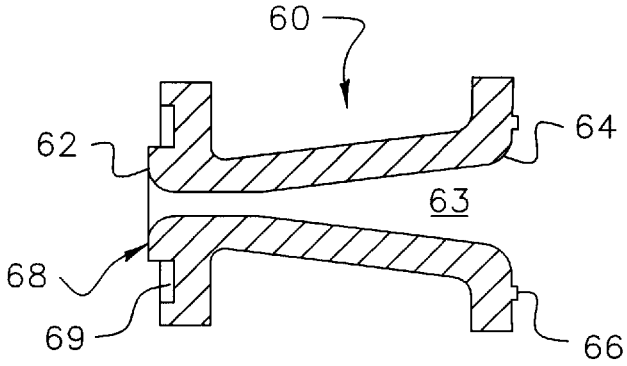
FIG. 5 is a cross sectional view of a throat for the foaming nozzle assembly.
Figure 6:
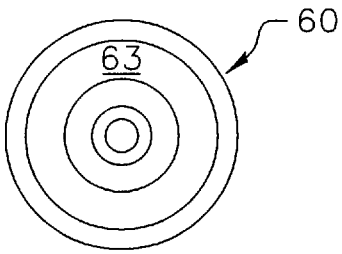
FIG. 6 is an end view from upstream of the throat of FIG. 5.
Figure 7:
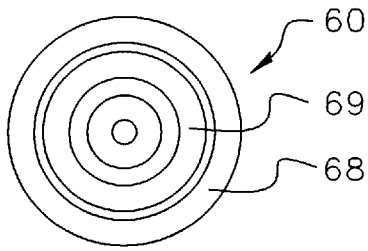
FIG. 7 is an end view from downstream of the throat of FIG. 5.
Figure 8:
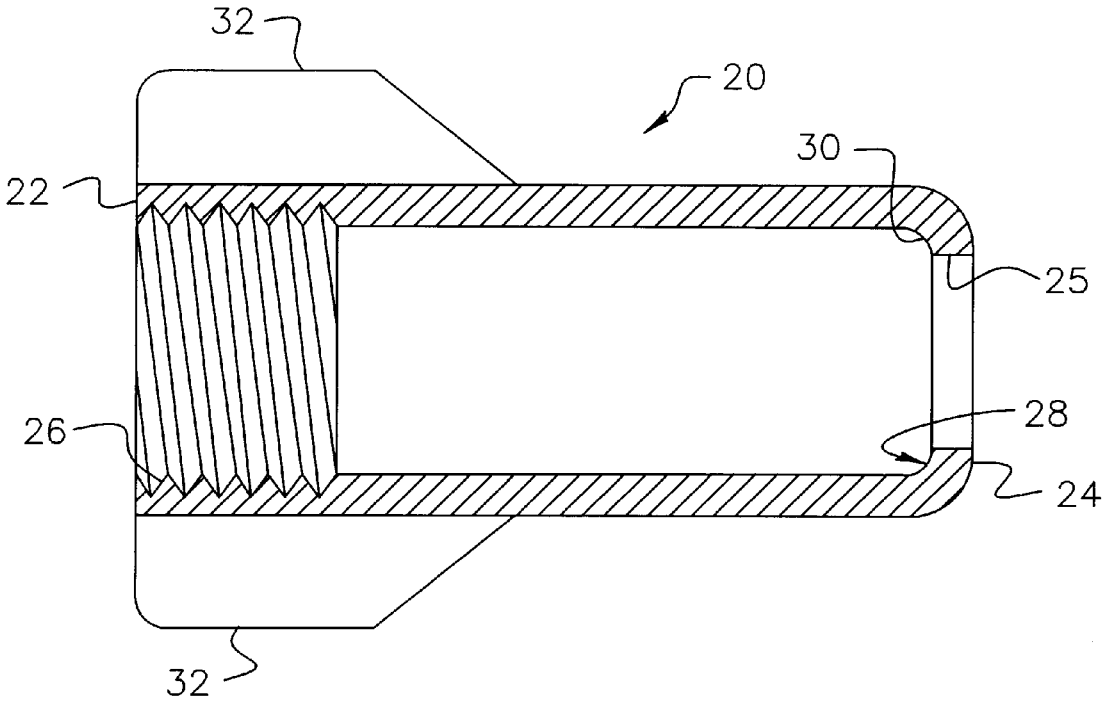
FIG. 8 is a cross sectional view of a housing for the foaming nozzle assembly.
Figure 9:
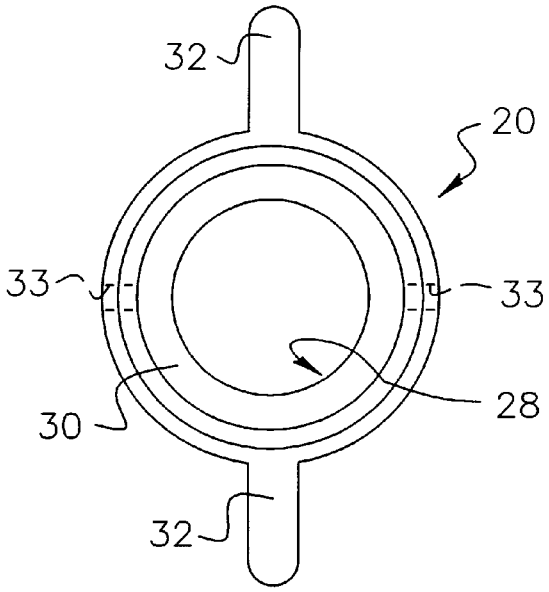
FIG. 9 is an end view of a housing for the foaming nozzle assembly.

Referring to FIG. 1, a foaming nozzle assembly 10 of the present invention is shown. The foaming nozzle assembly 10 operably connects to a source 12 of the liquid to be foamed. Typically, an interface between the foaming nozzle assembly 10 and the source 12 is a rigid self supporting wand 14. The wand 14 may include threads, snap fits or other mechanical connection configurations for operably connecting to the foaming nozzle assembly 10. However, it is understood that any of a variety of interfaces to the source 12 may be employed.

The foaming nozzle assembly 10 includes a housing 20, a nozzle tip 40, a throat 60 and a venturi deflector/nozzle 80.

The Housing

The housing 20 is a substantially tubular elongate member having an upstream wand engaging end 22 and a downstream nozzle end 24 disposed along a longitudinal axis. Preferably, the housing 20 is a cylindrical member having an interior and an exterior. A length of the interior adjacent the wand end 22 includes a plurality of threads 26. The nozzle end 24 includes a nozzle port 25, and a stop 28. The stop 28 is a collar projecting radially inward toward the longitudinal axis of the housing 20. The collar forms an annular seating surface 30. A plurality of ribs or fins 32 project from the housing 20 to form levers for assisting in the connection of the nozzle assembly 10 to the wand 14. The housing 20 includes at least one and preferably a plurality of air inlet ports 33 intermediate the wand end 22 and the nozzle end 24.

The housing 20 may be formed by any of a variety of materials that are inert to the compositions to be foamed, such as wear resistant polymers. A preferred material for construction of the housing is Delran as manufactured by E.I. DuPont.

The Nozzle Tip

The nozzle tip 40 is configured to be slidably received within the housing 20. The nozzle tip 40 is disposed in the nozzle end 22 of the housing 20 to provide an exit passage of the foaming composition from the foaming nozzle assembly 10. The nozzle tip 40 is sized to be slidably received within the wand end 22 of the housing 20 and slide to the nozzle end 24. The nozzle tip 40 has a through passage 43 from an upstream inlet 42 to a downstream foam spray outlet 44. The particular foam spray outlet 44 of the nozzle tip 40 is selected for producing the specific foam pattern and may be any of a variety of constructions. The foam spray outlet 44 defines an area through which the pressurized liquid area mixture exits the nozzle assembly 10. The nozzle tip 40 includes a shoulder 46 sized to contact the stop 28 and preclude further travel of the nozzle tip 40 with respect to the housing 20. Preferably, contact between the shoulder 46 and the seating surface 30 substantially precludes fluid flow therebetween under operating pressures. The upstream end 42 of the nozzle tip 40 forms an upstream seating surface 48 for contacting the throat 60.

The nozzle tip 40 may be formed of any of a variety of materials such as brass, wear resistant polymers or plastic. Alternatively, the nozzle tip may be one of a commercially available style.

The Throat

The throat 60 defines a central passage 63 and has a convergent upstream end 62 and a divergent downstream end 64. The throat 60 is also sized to be slidably received within the housing 20, passing through the wand end 22 to slide towards the nozzle end 24. The throat 60 includes peripheral flanges to locate, or center, the throat with respect to the housing 20. The downstream, divergent end 64 of the throat 60 includes a downstream seating surface 66 sized to cooperatively engage the upstream seating surface 48 of the nozzle tip 40. The convergent end 62 includes contact surfaces 68 for abutting the nozzle tip 40.

The upstream end 62 of the throat 60 includes at least one locating recess 69. The locating recess 69 is in the form of an annular recess in an upstream face of the throat 60.

In a preferred embodiment, the throat 60 has a total passage length approximately of 0.9 inches, and a convergent end diameter of approximately 0.078 inches. The convergent end diameter extends along the longitudinal axis for a length of approximately 0.3 inches, then flares at an angle of approximately 6° (12° conical angle) to a divergent end diameter of 0.3 inches. It has been found the same configuration of the throat 60 may be employed for a 0.1 and a 0.2 gallon per minute flow rate through the nozzle assembly 10.

The throat 60 may be formed of a plastic wear resistant polymer.

The Venturi Deflector/Nozzle

The venturi deflector/nozzle 80 is sized to be slidably received within the housing 20, passing from the wand end 22 toward the nozzle end 24. The venturi deflector/nozzle 80 defines a converging, funnel shaped central passage 83 extending along the longitudinal axis from an upstream open end 82 to a downstream restricted venturi end 84. The venturi deflector/nozzle 80 is sized to operably align the convergent end of the central passage 83 with the convergent end 62 of the throat 60. The venturi deflector/nozzle 80 may also include a pair of peripheral flanges to locate, or center the nozzle with respect to the housing 20. The downstream end 84 of the venturi deflector/nozzle 80 includes a plurality of locator bosses 86. The locator bosses 86 are located at an equal radius from the longitudinal axis and are sized to be received or registered within the locating recesses 69 of the throat 60. The locator bosses 86 of the venturi deflector/nozzle 80 and locating recesses 69 of the throat 60 thereby form a space between the venturi deflector/nozzle and the throat.

The locator bosses 86 and locating recesses 69 are sized to dispose a length of the venturi end 84 within the convergent end 62 of the throat 60. That is, a portion of the venturi deflector/nozzle 80 and the throat 60 overlap along the longitudinal axis, with the throat having the larger diameter and the restricted end of the venturi deflector/nozzle having the smaller diameter. An outer surface of the restricted end 84 of the venturi deflector/nozzle 80 and the convergent end 62 of the throat 60 define an introduction annulus 89 therebetween. The introduction annulus 89 is fluidly connected to the radial ports 33 in the housing 20.

Preferably, the outer surface 88 of the venturi end 84 of the venturi deflector/nozzle 80 forms deflector surfaces which redirect a radially inward air flow substantially parallel to the longitudinal axis.

The upstream, open end 82 of the venturi deflector/nozzle 80 includes a seating surface 92 for contacting the wand or an assembly seal.

The venturi deflector/nozzle 80 thus defines a primary flow control surface defined by the central passage 83 for directing liquid from the source 12 to the throat 60. The venturi deflector/nozzle 80 also defines a secondary flow control surface defined by the outer surface 88 for introducing air from the radial port to the liquid flow passing from the primary flow control surface substantially parallel to the longitudinal axis.

The venturi deflector/nozzle 80 may be configured to provide a variety of flow rates. For example, in a 0.2 gallon per minute configuration, the venturi deflector/nozzle 80 defines a central passage 83 having a length of 0.54 inches, with an open end 82 diameter of approximately 0.36 inches and a restricted end 84 inner diameter of 0.04 inches. The outer surface 88 of the restricted end 84, which defines a portion of the introduction annulus 89 has a diameter of 0.059 inches. The venturi deflector/nozzle 80 converges from the open end 82 to the restricted end 84 at an angle of approximately 20° from the longitudinal axis (conical angle of approximately 40°). In a 0.1 gallon per minute configuration, the restricted end 84 of the venturi deflector/nozzle defines an inner diameter of approximately 0.32 inches.

At least one of the seating surface 30 of the stop 28 and the shoulder 46 of the nozzle tip 40, and the upstream seating surface 48 of the nozzle tip 40 and the downstream divergent end 64 of the throat 60 include a raised bead which may be made in the formation process. The raised bead increases the effective seating pressure between the relative components, thereby increasing the sealing and reducing fluid flow therebetween.

The ratio of the area of the venturi end 84 and the area of the nozzle tip foam spray outlet 44 defines a balance between the need to have a sufficient flow velocity exposed to the radial air inlet ports 33 and a sufficient back pressure to induce turbulent mixing in the throat 60. The venturi end 84 and the foam spray outlet 44 act as a pair of resistors in series which are balanced to draw in sufficient air and generate foam from the air-liquid mixture. If the foam spray outlet 44 is sized too small, then the back pressure is too great and insufficient air is drawn through the ports 33 into the nozzle assembly 10. Conversely, if the foam spray outlet 44 is too large, then the air-liquid mixture does not mix in the throat 60 and no foam in generated.

Similarly, a sufficient flow rate through the venturi nozzle/deflector 80 is required to generate a usable quantity of foam. Further, the present design must accommodate the relatively low flow rate of less than 0.5 gallons per minute and often between 0.1. and 0.2 gallons per minute. Such a small flow rate requires a small orifice sizing at the foam outlet 44. However, small orifices create significant pressure drops across the orifice. The present design is selected to retain a sufficient pressure differential across the foam spray outlet 44 to permit ejection of a foam spray on the order of 5 to 10 feet from an initial liquid pressure of approximately 20 to 25 psi. The venturi nozzle/deflector 80 may also be formed of a wear resistant plastic polymer.

The present nozzle assembly 10 is selected to provide a liquid to generated foam volume of approximately 1:2.

Assembly

To assemble the foaming nozzle assembly 10, a nozzle tip 40 is disposed within the housing 20 such that the nozzle shoulder 46 contacts the collar of the stop 28 and passage of the nozzle tip through the nozzle port 25 in the housing is precluded. The throat 60 is then slidably disposed within the housing 20 such that the downstream, divergent end 64 of the throat 60 contacts the upstream end 42 of the nozzle tip 40.

The venturi deflector/nozzle 80 is then slidably disposed within the housing 20 to dispose the locator bosses 86 within the locator recesses 69 on the upstream end 62 of the throat 60.

An O-ring seal 94 is then disposed in the wand end of the housing. The O-ring is sized to retain the nozzle tip 40, the throat 60 and the venturi deflector/nozzle 80 within the housing 20. Thus, the components are operably aligned within the housing 20 and unintended separation of the component from the housing is substantially precluded.

The wand 14 is then threadingly engaged with the housing 20 until the end of the wand contacts the O-ring 94. Contact of the wand 14 and the O-ring 94 slightly compress the components thereby forming a sealed relation, as well as retaining them in their operable position. The present invention is directed to low pressure foaming devices and particularly those devices operating below approximately 35 psi. In particular, the present invention is directed to such low pressure systems operating at 25 psi or less.

Operation

In operation, the relatively low pressure is applied to the liquid source 12, thereby urging liquid from the source toward the nozzle tip 40 which is at ambient or atmospheric pressure. As the fluid flow is converged in the venturi deflector/nozzle 80, the velocity increases as it passes through the restricted end 84 and into the convergent end 62 of the throat 60. The increased velocity, pursuant to Bernoulli's equation, reduces the local pressure thereby drawing air in from the radial ports 33 through the housing 20, between the venturi deflector/nozzle 80 and the upstream end 62 of the throat 60 through the introduction annulus 89 and into the convergent end of the throat. The fluid stream and the introduced air then mix as the flow becomes turbulent and passes toward the divergent end 64 of the throat 60. The produced foam is then urged into the nozzle tip 40 where it is ejected through the orifice port 44 the pattern determined by the geometry and construction of the nozzle tip.

The present invention and its advantages will be understood from the foregoing description, and it will be apparent that various changes may be made thereto without departing from the true spirit and scope of the invention or sacrificing all of its material advantages, the form herein before described being merely preferred or exemplary embodiments thereof.

I claim:

1. A spray foaming nozzle assembly for releasably engaging a conduit, comprising:

(a) an elongate housing having a central aperture therethrough, a first end of the housing configured to releasably engage the conduit, and a second end of the housing including a stop, the housing including at least one radial port;

(b) a nozzle tip having a shoulder for engaging the stop, the nozzle tip sized to be slidably disposed into the housing to seat against the stop;

(c) a throat having a divergent end and a convergent end, the throat sized to be slidably disposed within the housing to contact the divergent end with the nozzle tip; and (d) a venturi nozzle/deflector sized to be disposed within the housing to contact the convergent end of the throat and having a deflector portion operably aligned with the radial port in the housing.

2. The foaming nozzle spray assembly of claim 1, wherein the housing is substantially cylindrical.

3. A foam generating nozzle, comprising:

(a) a tubular housing having an inlet, an outlet, an inwardly projecting stop intermediate the inlet and the outlet, and a port intermediate the inlet and the outlet;

(b) a nozzle tip sized to be slidably disposed through the inlet, the nozzle tip including a tab sized to contact the stop and preclude passage of the nozzle tip through the outlet, the nozzle tip having an exit port;

(c) a throat having an upstream end and a downstream end, the throat sized to be slidably received through the inlet, the throat defining a throat passage having a minimum throat periphery and the upstream end defined by a smaller periphery than the downstream end; and (d) a venturi nozzle sized to be slidably received through the inlet end, the venturi nozzle having a primary flow control surface and a secondary flow control surface, the primary flow control surface having an open end and a restricted end, the restricted end having a periphery that is less than the minimum throat periphery;

at least one of the housing, the throat and the venturi nozzle selected to fluidly connect the upstream end of the throat member and the port.

4. The foam generating nozzle of claim 3, wherein the inlet includes a plurality of threads.

5. The foam generating nozzle of claim 4, wherein the threads are disposed on an interior surface of the housing for operably connecting with the wand, such that threaded penetration of the wand into the housing is terminated by contact between the wand and the upstream end of the venturi nozzle.

6. The foam generating nozzle of claim 3, wherein an outer surface of the restricted end of the venturi nozzle and the throat periphery define an introduction annulus therebetween.

7. The foam generating nozzle of claim 3, wherein the primary flow control surface defines a funnel.

8. A venturi nozzle assembly for joining a primary flow and a secondary flow, comprising:

(a) a housing having a central passage therethrough, a duct opening at the central passage, and a radial port;

(b) a nozzle body sized to be slidably disposed within the central passage, the nozzle body having passage defined by an upstream periphery, a downstream periphery and a constriction intermediate the upstream periphery and the downstream periphery, the upstream periphery being greater than the constriction and the downstream periphery, the nozzle body having a radial port exposed to the duct and selected to introduce the secondary flow into the nozzle body adjacent the constriction; and (c) an annular flow director adjacent the constriction and the radial port, the flow director having a primary flow control surface and a secondary flow control surface, the primary flow control surface directing the primary flow through the axial passage, the secondary flow control surface having a curvilinear configuration for directing the secondary flow to a direction substantially parallel to the primary flow.

9. The venturi nozzle of claim 8, wherein the radial port is axially aligned with a downstream end of the secondary flow control surface.

10. The venturi nozzle of claim 8, wherein the curvilinear configuration of the secondary flow control surface such that of the secondary flow is substantially parallel to the primary flow as the secondary flow joins the primary flow.

11. The venturi nozzle of claim 8, wherein the curvilinear configuration of the secondary flow control surface redirects the secondary flow from a radially inward direction to a direction substantially parallel to the primary flow.

12. A foam generating nozzle, comprising:

(a) a tubular housing having an inlet, an outlet, and an inwardly projecting stop and a port intermediate the inlet and the outlet;

(b) a nozzle tip sized to be slidably disposed through the inlet, the nozzle tip including a shoulder sized to contact the stop and preclude passage of the nozzle tip through the outlet, the nozzle tip having an exit port;

(c) a throat member having an upstream end and a downstream end, the throat member sized to be slidably received through the inlet, the throat member defining a throat passage defined by a minimum throat periphery adjacent the upstream end; and (d) a venturi nozzle sized to be slidably received through the inlet, the venturi nozzle having a primary flow control surface and a secondary flow control surface, the primary flow control surface defining a funnel having an open end and a restricted end, the restricted end having a periphery that is less than the minimum throat periphery;

the housing, the nozzle tip, the throat member and the venturi nozzle selected to fluidly connect the upstream end of the throat member and the port.

13. The foam generating nozzle of claim 12, wherein a spacer is integral with the venturi nozzle.

14. The foam generating nozzle of claim 12, wherein the port is radially spaced from the secondary control surface.

* * * * *